US011581689B2

(12) United States Patent
Kopansky et al.

(10) Patent No.: US 11,581,689 B2
(45) Date of Patent: Feb. 14, 2023

(54) BONDING RESISTANCE AND ELECTROMAGNETIC INTERFERENCE MANAGEMENT OF A SURFACE MOUNTED CONNECTOR

(71) Applicant: Eaton Intelligent Power Limited, Dublin (IE)

(72) Inventors: Gregory Kopansky, Philadelphia, PA (US); Michael Joseph Schneider, Secane, PA (US)

(73) Assignee: Eaton Intelligent Power Limited, Dublin (IE)

( * ) Notice: Subject to any disclaimer, the term of this patent is extended or adjusted under 35 U.S.C. 154(b) by 155 days.

(21) Appl. No.: 17/104,143

(22) Filed: Nov. 25, 2020

(65) Prior Publication Data

US 2021/0159655 A1 May 27, 2021

Related U.S. Application Data

(60) Provisional application No. 62/940,486, filed on Nov. 26, 2019.

(51) Int. Cl.
*H01R 3/00* (2006.01)
*H01R 43/02* (2006.01)
*H01R 13/6584* (2011.01)

(52) U.S. Cl.
CPC ..... *H01R 43/0207* (2013.01); *H01R 13/6584* (2013.01)

(58) Field of Classification Search
CPC .... H01R 12/592; H01R 12/79; H01R 4/2433; H01R 13/5812
See application file for complete search history.

(56) References Cited

U.S. PATENT DOCUMENTS 3,254,402 A 6/1966 Balamuth et al.
3,376,179 A 4/1968 Balamuth
5,871,363 A * 2/1999 Kimura ..... H01R 13/62905 439/157
6,302,720 B1 * 10/2001 Muller ..... H01R 13/6461 439/157
6,354,852 B2 * 3/2002 Noro ..... H01R 13/62938 439/157

(Continued)

FOREIGN PATENT DOCUMENTS

DE 10 2018 202 955 A1 8/2019
EP 2 104 188 A1 9/2009

(Continued)

OTHER PUBLICATIONS

Extended European Search Report for Application No. 20209587.3 dated Mar. 31, 2021.

*Primary Examiner* — Phuong Chi Thi Nguyen
(74) *Attorney, Agent, or Firm* — Merchant & Gould P.C.

(57) ABSTRACT

A first component, such as an electrical connector, can be mechanically connected to a second component, such as a surface, and separately electrically bonded to the second component using a third component, such as foil. The third component can be ultrasonically welded to the first component and separately ultrasonically welded to the second component. In some cases, multiple third components can be utilized to cover a seam between the first and second components.

17 Claims, 4 Drawing Sheets

(56) References Cited

U.S. PATENT DOCUMENTS

| | | | | |
|---|---|---|---|---|
| 6,767,231 | B1 * | 7/2004 | Martin | H01R 13/62944 439/372 |
| 6,811,417 | B2 * | 11/2004 | Itoh | H01R 13/5219 439/157 |
| 2006/0234528 | A1 | 10/2006 | Nakano et al. | |

FOREIGN PATENT DOCUMENTS

| | | | |
|---|---|---|---|
| EP | 3 163 690 | A1 | 5/2017 |
| GB | 1 534 265 | A | 11/1978 |
| JP | 2006-331803 | A | 12/2006 |

* cited by examiner

BONDING RESISTANCE AND ELECTROMAGNETIC INTERFERENCE MANAGEMENT OF A SURFACE MOUNTED CONNECTOR

CROSS REFERENCE TO RELATED APPLICATIONS

This application claims the benefit of provisional application Ser. No. 62/940,486, filed Nov. 26, 2019, which is incorporated herein by reference in its entirety.

BACKGROUND

Corrosion resistant steel (CRES) bodies are being used with electrical connectors to protect the connectors in harsh environments. The CRES bodies inhibits corrosion, deformation, and other such defects in the electrical connector that may otherwise occur over time. There is also a push to reduce cost and weight of the equipment to which the electrical connectors are mounted. Accordingly, housings of the equipment are being formed from lighter weight materials, such as Aluminum.

When mounting an electrical connector to a surface of equipment, such as a wall of an enclosure, it is useful to electrically bond the electrical connector to the surface to equalize the electrical potential therebetween, e.g., to reduce the risk of electrical shock. One method of electrically bonding an electrical connector to a surface is to directly weld the electrical connector to the surface. However, such direct welding is only commercially feasible when the material forming the electrical connector is chemically compatible with the material forming the surface. For example, it may not be viable to weld a CRES-bodied electrical connector directly to an aluminum surface. Further, the shock and vibration produced during such an attempt may yield a weld with insufficient strength to withstand a harsh environment. Moreover, corrosion, oxidation, and environmental factors (e.g., dust, water, etc.) of the surface and/or the electrical connector also may degrade the electrical connection therebetween.

In addition, the equipment may require shielding from electromagnetic interference (EMI) or to otherwise meet electromagnetic compatibility (EMC) requirements. However, shielding gaskets can be expensive.

Further developments in such systems are desired.

SUMMARY

Some aspects of the disclosure are directed to a connection system having long term electrical bonding resistance stability; and methods of creating such a connection system.

In accordance with some aspects of the disclosure, an outer body of an electrical connector is mechanically mounted (e.g., fastened, threaded, etc.) to a surface (e.g., to a wall of an enclosure). A separate, electrically conductive piece is then electrically connected to both the connector outer body and the surface. In certain examples, the separate conductive piece is ultrasonically welded to the connector outer body and to the surface.

In certain implementations, the conductive piece has a first section welded (e.g., ultrasonically) to the electrical connector and a second section welded (ultrasonically) to the surface. In certain implementations, the conductive piece is formed of a material that is different from both the electrical connector outer body and the surface. For example, two materials are different if they are formed of different elements or have other chemical distinctions, have different densities, and/or have different hardness. In certain implementations, the electrical connector outer body and the surface are formed of different materials.

In some examples, a single conductive piece is welded between the electrical connector and the surface. In other examples, multiple conductive pieces can be utilized. In certain examples, the conductive pieces can be arranged sufficiently close together and to cover a sufficient percentage of the seam between the electrical connector and the surface to manage EMI stress at the seam.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure is directed to an electrical connector that is both mechanically mounted and separately electrically bonded to a surface; and method for forming the electrical bond.

Figure 1:
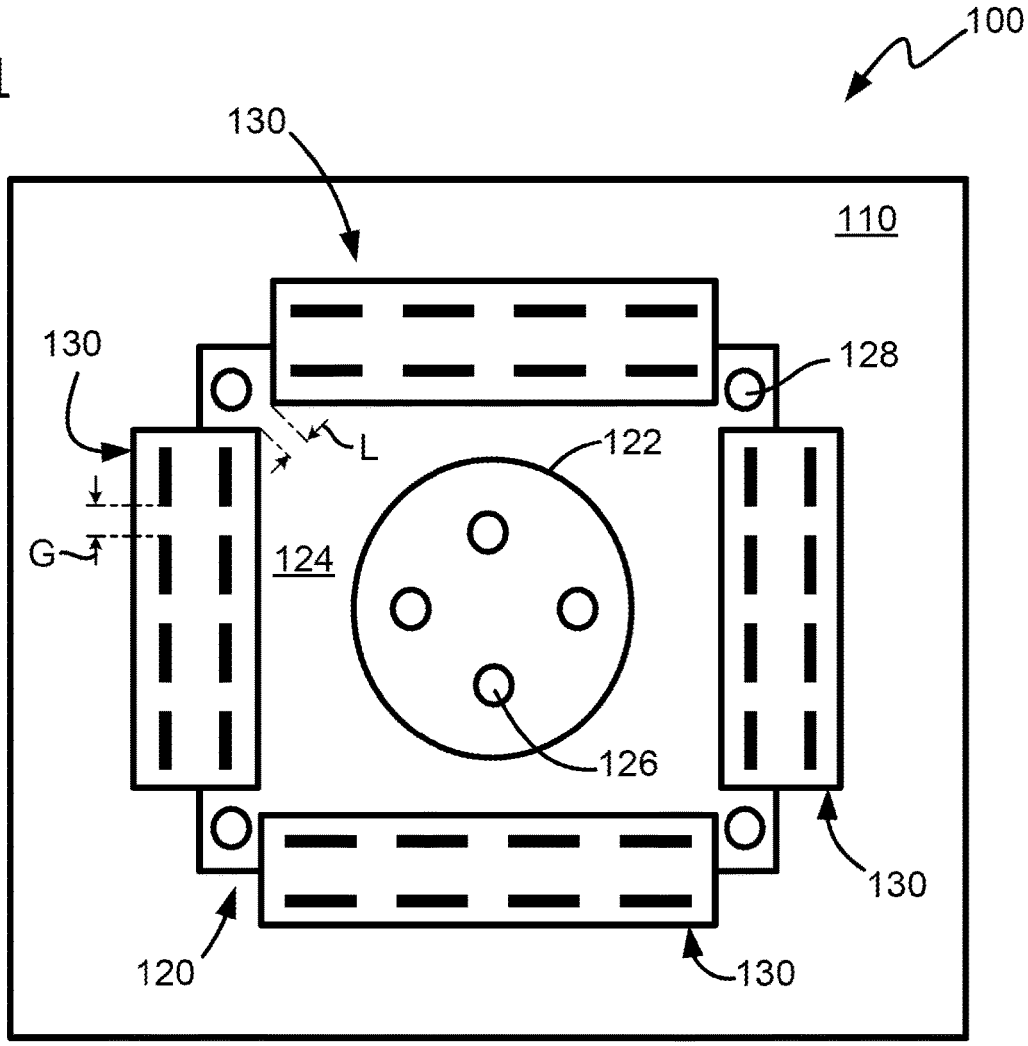
FIG. 1 is a schematic diagram of an example connection system including an electrical connector mechanically fastened to a surface and separately electrically bonded to the surface.
Figure 2:
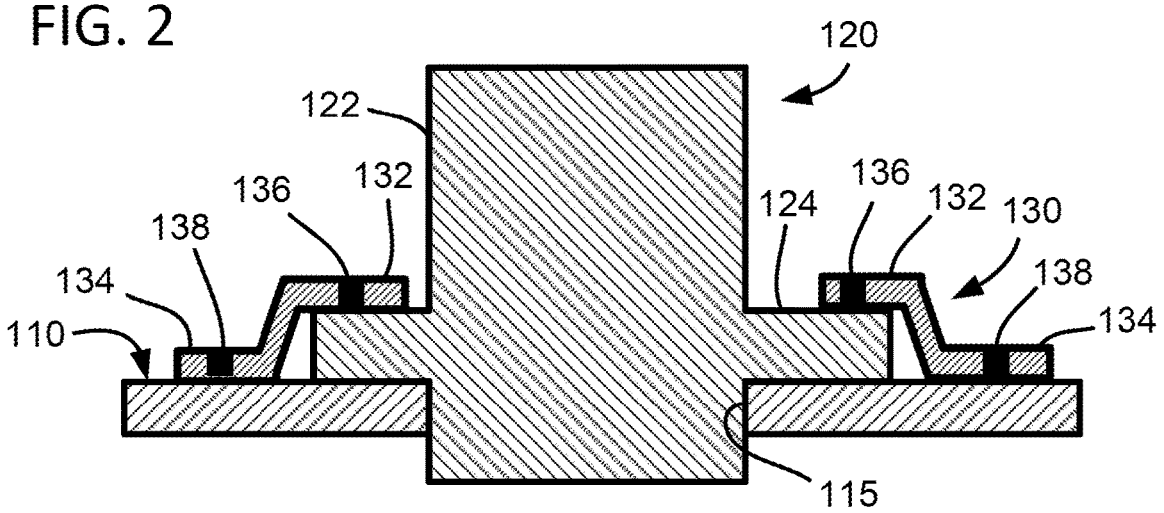
FIG. 2 is a schematic diagram of the connection system of FIG. 1 shown in cross-section with the electrical connector shown as a block for ease in viewing.

As shown in FIGS. 1-2, a connection system 100 includes a surface 110, a connector 120 mounted to the surface 110, and a conductive member 130 that electrically bonds the connector 120 to the surface 110. The conductive member 130 is formed of a material that may be different from one or both of the surface and the connector 120. The conductive member 130 forms an electrical bond between the connector 120 and the surface 110. In some implementations, the surface 110 and the connector 120 are formed of different materials. In other implementations, however, the surface 110 and the connector 120 can be formed of the same material. The surface 110 defines an aperture 115 therethrough at which the connector 120 is mounted. The surface 110—at least around an aperture 115—is formed of a first material. In certain examples, the first material includes Aluminum, such as a 6061-T6 alloy or other Aluminum alloys). Other materials are possible. In certain implementations, the surface 110 forms a wall of an enclosure holding one or more electrical or electronic components.

The connector 120 extends through the aperture 115 so that a first end of the connector 120 is accessible from one side of the surface 110 and an opposite end of the connector 120 is accessible from the opposite side of the surface 110. In some implementations, the connector 120 terminates a cable at one or both ends. In other implementations, the connector 120 defines ports at one or both ends to receive a cable plug. In some implementations, the connector 120 is an electrical connector (e.g., that connects to the electrical or electronic components within the enclosure). In other implementations, the connector 120 is a fiber optic connector. In other implementations, the connector 120 is a hybrid connector having both optical and electrical contacts.

In general, the connector 120 includes an outer body 122 formed of a second material. In some examples, the second material is different from the first material. For example, the first material may include Aluminum while the second material includes steel. Other materials are possible. In other examples, the first and second materials may be the same.

The connector 120 is mechanically mounted to the surface 110 at the aperture 115. In an example, the connector 120 can be threaded to the surface 110. In other examples, the connector 120 can be fastened to the surface 110 with one or more fasteners 128 (e.g., bolts, screws, etc.). In certain examples, the connector 120 includes an outer body 122 carrying a connection arrangement for electrically and/or optically connecting the first and second ends of the connector 120. In various examples, the connection arrangement includes one or more electrical contacts 126 (shown schematically in FIG. 1), one or more ferrule alignment sleeves, etc.

In certain examples, the outer body 122 includes a radial mounting flange 124 through which the fasteners 128 can be installed. At least the mounting flange 124 of the outer body 122 is formed of the second material. In certain examples, the second material is sufficiently dissimilar to the first material so as to effectively prohibit direct welding therebetween. In examples, the second material may differ in chemical makeup, hardness, density, or other criteria from the first material. In certain examples, the entire outer body is formed of the second material. In certain examples, the second material includes a corrosion resistant steel. In an example, the second material includes a stainless steel (e.g., 304 stainless steel). Other materials are possible.

In accordance with certain aspects of the disclosure, a conductive member 130 formed of a third material may be used to form the electrical bonding connection between the electrical connector 120 and the surface 110. In certain examples, while the conductive member 130 may provide a weak mechanical connection between the electrical connector 120 and the surface 110, the electrical connector 120 is separately connected to the surface 110 with a more robust mechanical connection (e.g., threading, fasteners, etc.).

The third material is electrically conductive. In certain implementations, the third material is compatible with the first material for welding (e.g., ultrasonic welding) and is compatible with the second material for welding (e.g., ultrasonic welding). In certain examples, the third material includes Nickel. Other materials, such as copper, are possible.

The conductive member 130 has a first region 132 and a second region 134. The first region 132 is welded (e.g., ultrasonically) to the outer body 122 of the electrical connector 120. The weld provides electrical bonding stability between the first and third materials. The second region 134 is welded (e.g., ultrasonically) to the surface 110. The weld provides electrical bonding stability between the second and third materials. Accordingly, the conductive member 130 provides a current path between the first and second materials.

In certain implementations, the first and second regions 132, 134 are disposed at opposite ends of the conductive member 130. Other configurations are possible. In some implementations, the conductive member 130 includes a flexible sheet that can be formed into a desired shape or otherwise easily fitted between the connector 120 and the surface 110. In certain examples, the conductive member 130 includes foil. In other implementations, the conductive member 130 has a rigid formation that is designed to extend between the connector outer body 122 and the surface 110. The first and second regions 132, 134 of such a rigid formation are shaped and sized to promote welding (e.g., ultrasonic welding) at those regions. In use, the outer body 122 of the connector 120 is attached to the surface 110 using a mechanical connection. For example, a mounting flange 124 may be laid over the surface 110 and bolts 128 may be installed through corners of the mounting flange 124 and into the surface 110. A conductive member 130 is positioned between the outer body 122 (e.g., the mounting flange 124) and the surface 110. For example, a piece of foil may be spread over the surface 110 and mounting flange 124.

In certain examples, pressure is applied between the first region 132 of the conductive member 130 and the connector body 122 (e.g., at the mounting flange 124). Then, the first region 132 is ultrasonically welded to the outer body 122 using a welding device to create an electrical bond between the connector body 122 and the conductive member 130. The second region 134 is ultrasonically welded to the surface 110 using the welding device to create an electrical bond between the surface 110 and the conductive member 130.

In certain implementations, the conductive member 130 creates a sufficient electrical pathway so that the electrical bonding resistance between the connector outer body 122 and the surface 110 is no more than 5 milliohms. In certain implementations, the conductive member 130 creates a sufficient electrical pathway so that the electrical bonding resistance between the connector outer body 122 and the surface 110 is no more than 4 milliohms. In certain implementations, the conductive member 130 creates a sufficient electrical pathway so that the electrical bonding resistance between the connector outer body 122 and the surface 110 is no more than 3 milliohms. In certain implementations, the conductive member 130 creates a sufficient electrical pathway so that the electrical bonding resistance between the connector outer body 122 and the surface 110 is no more than 2.5 milliohms. In certain implementations, the conductive member 130 creates a sufficient electrical pathway so that the electrical bonding resistance between the connector outer body 122 and the surface 110 is less than 2.5 milliohms.

In certain implementations, the welding device includes a press, an anvil, a generator, and a dispenser. The press holds two components (e.g., the connector and the conductive member and/or the surface and the conductive member) under pressure. The pressed components are mounted to the anvil. The generator produces high powered electrical signals that are converted to ultrasonic acoustic vibrations by dispenser. For example, the dispenser may include a piezoelectric transducer or other such converter. The dispenser also includes a horn to emit the acoustic vibrations.

In certain implementations, the conductive member 130 covers or substantially covers the seams between the connector 120 and the surface 110. In such implementations, the conductive member 130 may provide some EMI shielding to the electronics provided within the enclosure or otherwise on the other side of the surface 110.

Figure 3:
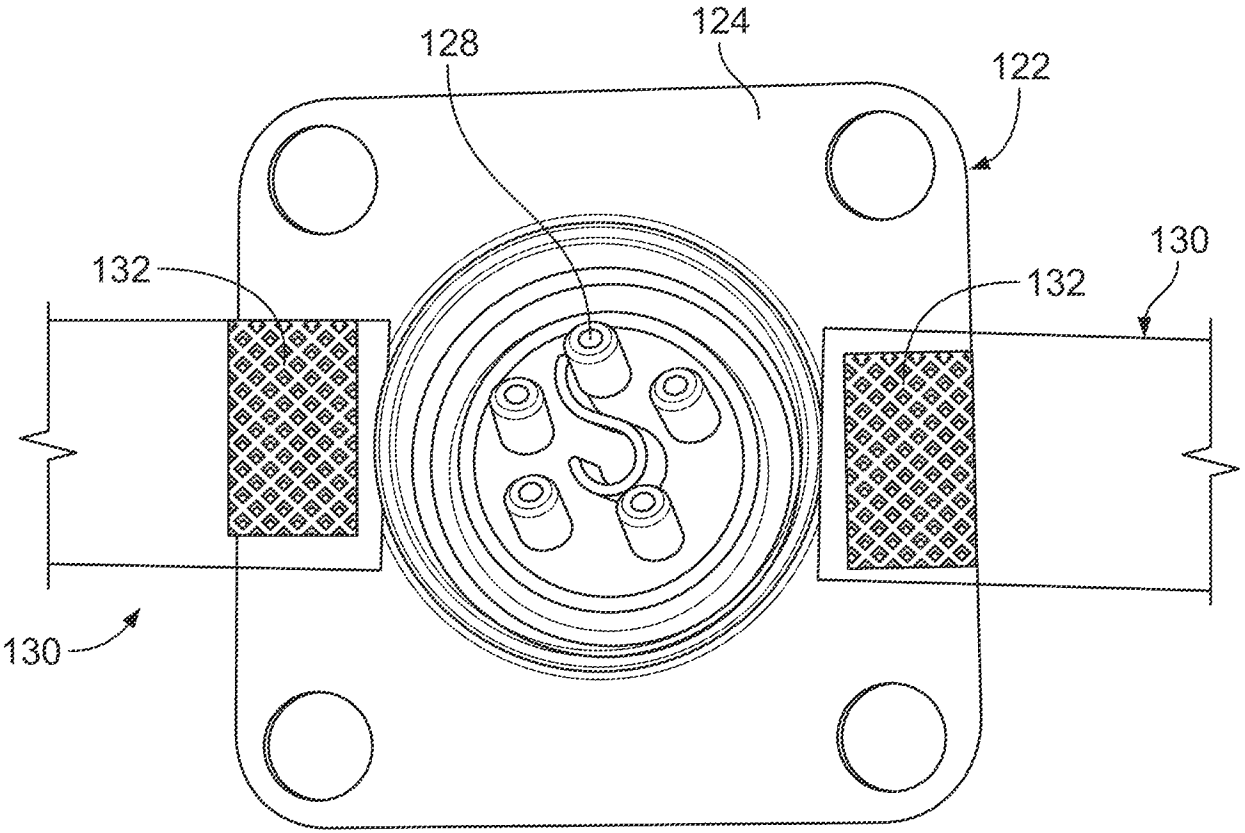
FIG. 3 shows a top plan view of an example implementation of the electrical connector of FIG. 1 with a first region of an example conductive member ultrasonically welded to a mounting flange thereof, the illustrated conductive member being foil, the electrical connector being shown separate from the surface for ease in viewing.
Figure 4:
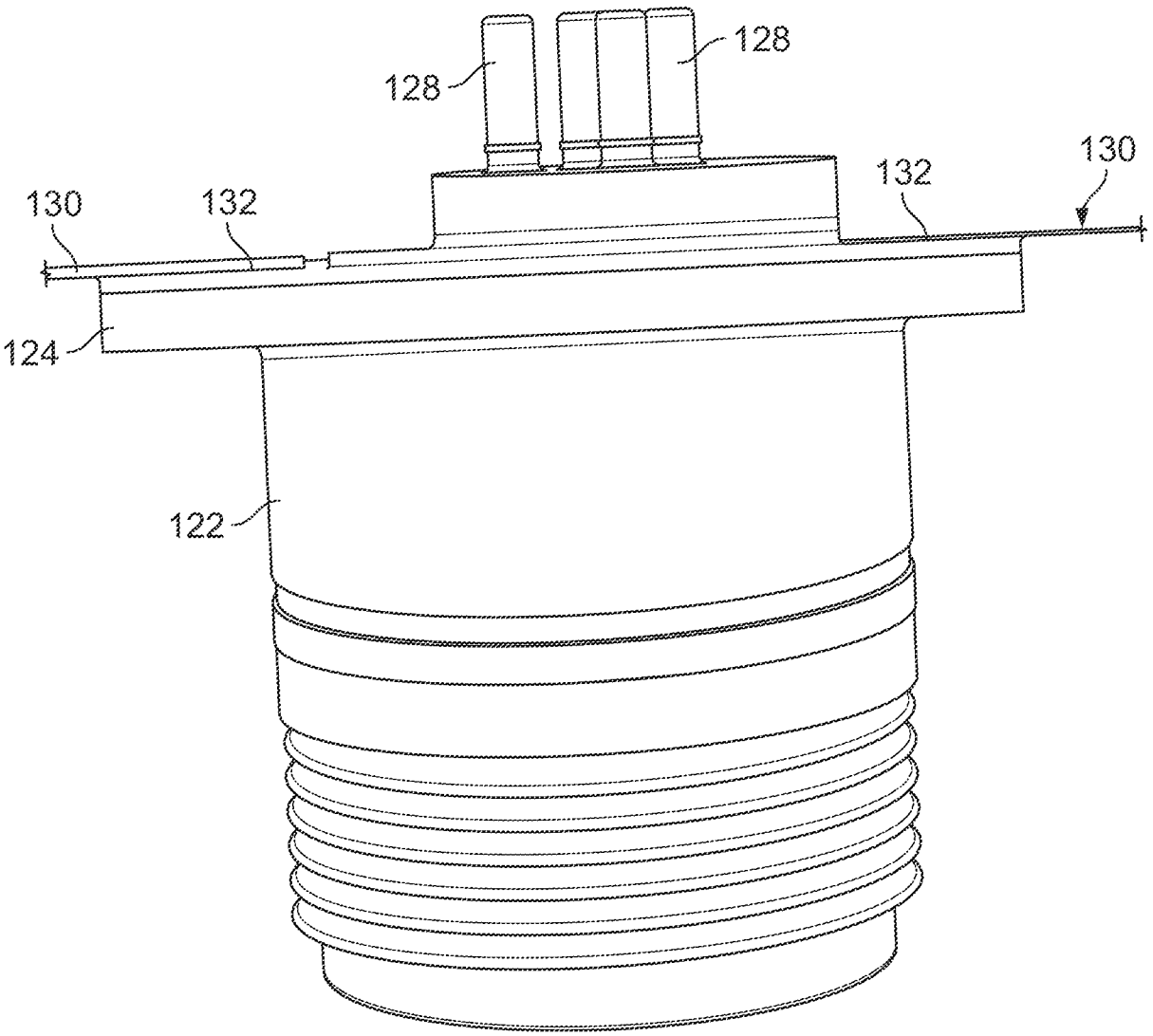
FIG. 4 shows a side elevational view of the example electrical connector and conductive member of FIG. 3.
Figure 5:
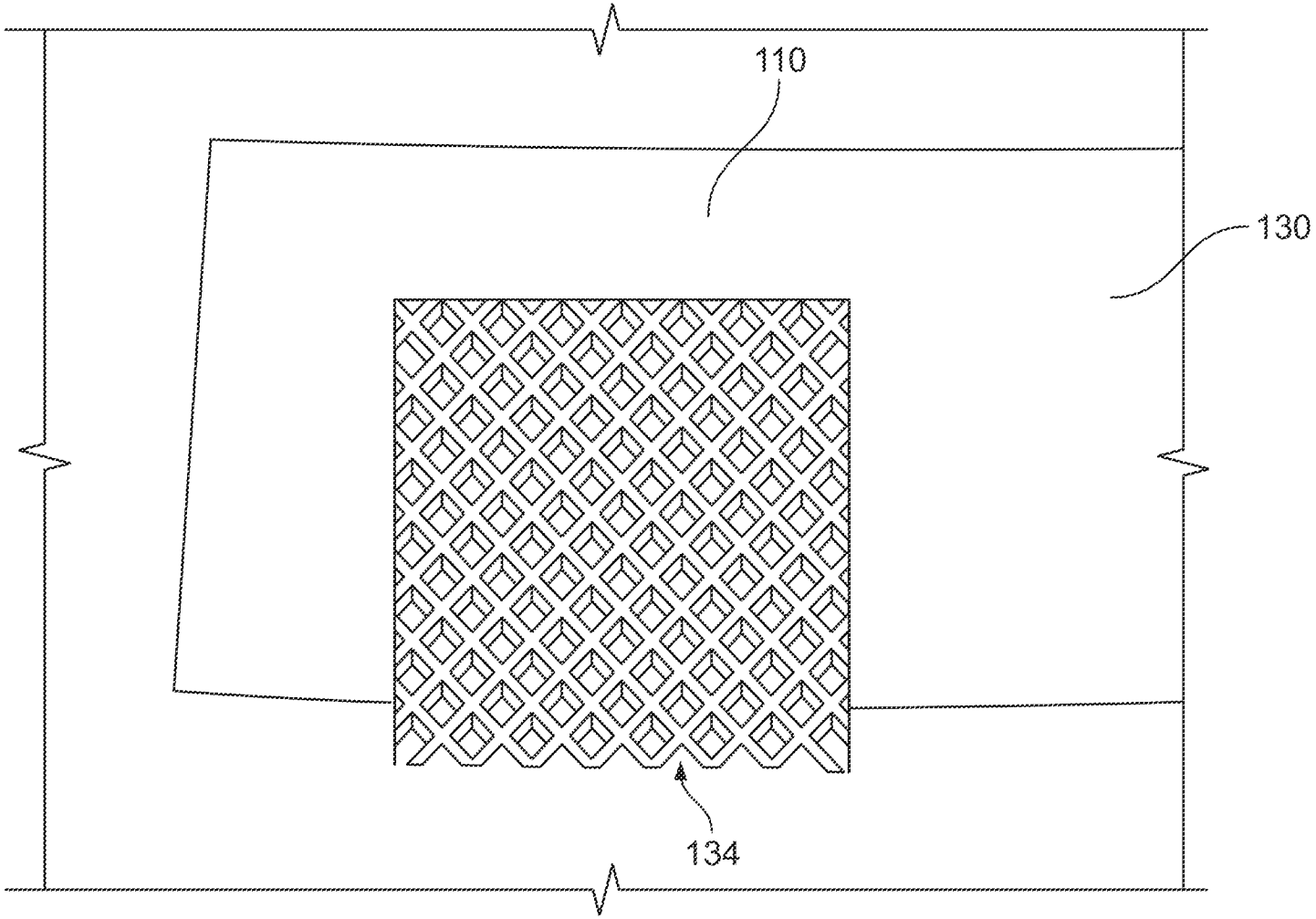
FIG. 5 is a top plan view of a second region of the conductive member of FIG. 3 shown ultrasonically welded to an example surface.

In certain implementations, ultrasonically welding forms a pattern of welds with breaks in between. For example, FIGS. 3-5 illustrate example ultrasonic welds. In FIGS. 3 and 4, a first portion 132 of a conductive member 130 is ultrasonically welded to a mounting plate 124 of a connector 120. In FIG. 5, a second portion 134 of the conductive member 130 is ultrasonically welded to a surface 110. As shown, a plurality of solid-state welds extend over the regions 132, 134. In certain examples, the welds are arranged in a plurality of rows, a matrix, or other pattern. In certain examples, a gap length G (FIG. 1) between adjacent welds defines the maximum wavelength capable of passing through the conductive member 130. For example, only electromagnetic waves having half-wavelengths smaller than the gap length G may be able to pass through the weld cage of the conductive member 130.

In some implementations, the conductive member 130 extends around a perimeter of the connector 120. For example, the conductive member 130 can be shaped to fit over the mounting plate 124 and surface 110 while accommodating the mechanical connection therebetween. In other implementations, the conductive member 130 is one of a plurality of conductive members 130 that cooperate to cover at least part of the seam between the connector 120 and the surface 110. In the example shown in FIG. 1, four conductive members 130 cover the seam—one conductive member 130 for each side of the mounting flange 124. When multiple conductive members 130 are utilized, a gap length L (FIG. 1) between adjacent ones of the conductive members 130 defines the maximum wavelength capable of passing between the conductive members 130. For example, only electromagnetic waves having half-wavelengths smaller than the gap length L may be able to pass between the conductive members 130. Accordingly, EMI stress can be managed within a predetermined tolerance by appropriately spacing the conductive members 130 relative to each other.

Using multiple conductive members 130 may allow for better accommodation of the mechanical connection (e.g., allow space for the fasteners 128). Alternatively, space for the mechanical connection can be provided in a single-piece conductive member. For example, a sheet of foil may be extended over the connector with a hole punched out for the main connector body and contacts 126 and additional holes punched out for the fasteners 128.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A connection system comprising:

a surface defining an aperture, the surface being formed of a first material;

a connector mounted to the surface at the aperture with a mechanical connection, the connector including an outer body carrying a connection arrangement, the outer body being formed of a second material; and a conductive member having a first region and a second region, the first region of the conductive member being ultrasonically welded to the outer body of the connector, the second region of the conductive member being ultrasonically welded to the surface, the conductive member being formed of a third material that is different from the first and second materials, the conductive member electrically connecting together the outer body of the connector and the surface.

2. The connection system of claim 1, wherein the second material is different from the first material.

3. The connection system of claim 1, wherein the surface forms a wall of an enclosure.

4. The connection system of claim 1, wherein the mechanical connection includes a plurality of bolts extending through both the electrical connector and the surface, wherein the outer body of electrical connector includes a mounting flange, the mounting flange defining apertures for receiving the bolts, wherein the first region of the conductive member extends over the mounting flange and the second region of the conductive member extends over the surface.

5. The connection system of claim 1, wherein the first region of the conductive member is ultrasonically welded using a plurality of welds; and, wherein the second region of the conductive member is ultrasonically welded using a plurality of welds, wherein breaks between the welds have lengths that do not exceed a maximum allowable wavelength of an electro-magnetic stress wave.

6. The connection system of claim 1, wherein the outer body of the electrical connector directly contacts the surface.

7. The connection system of claim 1, further comprising an EMI gasket disposed between the outer body of the electrical connector and the surface.

8. The connection system of claim 1, wherein the conductive member is a rigid structure extending between the outer body of the electrical connector and the surface.

9. The connection system of claim 1, wherein the first material includes aluminum, such as an aluminum alloy; and, wherein the second material is stainless steel, such as 304 grade stainless steel.

10. The connection system of claim 1, wherein the conductive member electrically connects the outer body of the electrical connector and the surface to have a bonding resistance of less than 2.5 milliohms.

11. The connection system of claim 1, wherein the conductive member is one of a plurality of conductive members that each have a respective first region ultrasonically welded to the outer body of the electrical connector and a respective second region ultrasonically welded to the surface.

12. The connection system of claim 11, wherein the plurality of conductive members covers at least a majority of a perimeter of the electrical connector.

13. The connection system of claim 1, wherein the conductive member includes a flexible sheet.

14. The connection system of claim 13, wherein the flexible sheet includes a foil.

15. A connection system comprising:

an enclosure holding electronics, the enclosure including a wall defining an aperture;

a connector mounted to the wall at the aperture with a mechanical connection, the connector including an outer body and connection means having a first end accessible from an interior of the enclosure and a second end accessible from an exterior of the enclosure; and a conductive arrangement including at least one conductive member having a first region and a second region, the first region of the conductive member being ultrasonically welded to the outer body of the connector, the second region of the conductive member being ultrasonically welded to the wall, the conductive arrangement electrically connecting together the outer body of the connector and the wall, the conductive arrangement being separate from the mechanical connection, the conductive arrangement extending over a majority of a seam between the connector and the wall.

16. The connection system of claim 15, wherein the connector includes one of an electrical connector, an optical connector, and a hybrid connector.

17. The connection system of claim 15, wherein the at least one conductive member is one of a plurality of conductive members of the conductive arrangement, wherein the conductive members cooperate to extend over the majority of the seam.

* * * * *